US005287721A

United States Patent [19]

Samsel

[11] Patent Number: 5,287,721

[45] Date of Patent: Feb. 22, 1994

[54] APPARATUS AND METHOD FOR FORMING CURVED NEEDLES

[75] Inventor: W. Scott Samsel, Bristol, Conn.

[73] Assignee: United States Surgical Corporation, Norwalk, Conn.

[21] Appl. No.: 928,797

[22] Filed: Aug. 12, 1992

[51] Int. Cl.[5] ..... B21F 1/00; B21F 45/00; B21G 1/00

[52] U.S. Cl. ..... 72/400; 72/403; 72/35; 163/1; 163/5; 140/102

[58] Field of Search ..... 72/401, 403, 400, 399, 72/456, 35; 163/1, 5; 59/27, 23; 140/88, 102

[56] References Cited

U.S. PATENT DOCUMENTS

| | | | |
|---|---|---|---|
| 251,397 | 12/1881 | Acheson | 59/27 |
| 263,991 | 9/1882 | Svensson | 140/88 |
| 288,840 | 11/1883 | Miles | 72/456 |
| 500,058 | 6/1893 | Ellis | 140/88 |
| 1,360,021 | 11/1920 | Rehfuss | 59/27 |
| 1,432,573 | 10/1922 | Senft | 59/23 |
| 1,433,879 | 10/1922 | Fancher | 72/399 |
| 1,666,380 | 4/1928 | Heinle | 59/27 |
| 1,744,030 | 1/1930 | Chadwick | 72/403 |
| 2,986,194 | 5/1961 | DeMarco | 72/399 |
| 4,209,978 | 7/1980 | Johansson | 59/27 |
| 4,524,771 | 6/1985 | McGregor et al. . | |
| 4,621,515 | 11/1986 | Sanderson | 140/88 |
| 4,680,926 | 7/1987 | Lange | 59/27 |
| 4,694,644 | 9/1987 | Rudy | 59/27 |
| 4,809,532 | 3/1989 | Tanaka | 140/88 |
| 5,041,127 | 8/1991 | Troutman . | |
| 5,056,351 | 10/1991 | Stiver | 72/35 |

FOREIGN PATENT DOCUMENTS

| | | | |
|---|---|---|---|
| 928644 | 6/1955 | Fed. Rep. of Germany | 140/88 |
| 309338 | 12/1988 | Japan | 163/1 |

*Primary Examiner*—Daniel C. Crane

[57] ABSTRACT

Apparatus for forming curved needles from needle blanks of differing sizes and material characteristics having a guide die, driven by a linear actuator, for biasing the needle blank against a forming surface. Bending dies also driven by linear actuators are provided for bending the ends of the needle blank around the top of the forming surface. Adjusting micrometers are provided to adjust the contact point at which the bending dies contact the needle blank. The apparatus can therefore be readily adapted for differing needle stocks. The entire bending process is automated so that uniform needles may be rapidly produced.

48 Claims, 6 Drawing Sheets

APPARATUS AND METHOD FOR FORMING CURVED NEEDLES

BACKGROUND OF THE INVENTION

1. Field of the Invention

This invention relates to apparatus and methods for forming curved articles from elongated workpieces and more particularly, this invention relates to apparatus and methods for forming curved surgical needles from elongated needle blanks.

2. Discussion of the Related Art

Surgical needles are readily available in many different configurations; for example, straight, bowed and highly curved. Curved needles are advantageous over other needle configurations in many surgical procedures for a variety of reasons, among which are uniformity of entry depth for multiple sutures and proper "bite" of the tissue surrounding the incision or wound. It is extremely important, therefore, that each needle be manufactured to meet stringent performance specifications. Inconsistency of curvature of the finished needles could mean the difference between a successful, unremarkable surgical procedure or further injury to a patient resulting from improperly formed needles.

It is known in the prior art to form curved surgical needles by bending wire about a mandrel whose surface contains the desired curves. It is further known that because needles are made of steel or similar springy materials, the mandrel used should have tighter curves than those desired in the final needle to allow for some springback after the bending operation. A disclosure of such features may be found in, for example, U.S. Pat. No. 4,524,771 to McGregor et al. The demand for such precision made needles is great enough to make the costs of producing them manually or by other conventionally slower methods much higher than if they could be produced more rapidly. A continuing need still exists, therefore, for an apparatus which can consistently and rapidly form curved needles from flat needle blanks of differing materials, in order to assure that each curved needle is formed having virtually the same curvature.

SUMMARY OF THE INVENTION

Apparatus is provided for forming curved needles from elongated workpieces, which comprises a frame, including a forming surface demountably attached thereto, guide means movably mounted on the frame for securely biasing the elongated workpieces against the forming surface, and bending means movably mounted on the bending frame for bending the elongated workpieces about the forming surface. The bending means comprises at least one bending die disposed adjacent to the forming surface. Preferably, however, first and second bending means are mounted on the frame and are adapted for sequentially urging the elongated workpiece about the forming surface. Alternatively, the bending means may be adapted for simultaneously urging the elongated workpiece about the forming surface. Each bending means further comprises a workpiece contact plate demountably attached thereto.

The forming surface of the apparatus preferably comprises a circular mandrel disposed adjacent to and aligned with a corresponding contoured wall of the guide die. In another embodiment, the forming surface may be movable and adapted for securely biasing the elongated workpieces against retaining means, the forming means being disposed adjacent to the retaining means.

Preferably, the apparatus also comprises adjusting means, disposed adjacent to the bending means, for adjusting the position of the bending means in relation to an end portion of the elongated workpieces. The adjusting means comprises directing means mounted on the frame adjacent to the bending die. The adjusting means further comprises at least one micrometer, operably mounted adjacent to the directing means, to engage and position the directing means.

The guide means comprises a guide die adapted for bending the elongated workpiece about the forming surface and biasing the elongated workpiece against the forming surface upon movement of the die towards the forming surface. The guide die comprises aligning means for aligning the elongated workpiece in longitudinal relation to the forming surface. The aligning means comprises at least one groove, adapted for receiving the elongated workpiece on the guide die.

Urging means are operatively connected to the guide means and the bending means for urging the guide means and the bending means in a reciprocating motion. The urging means preferably comprise linear actuators which are operated pneumatically, hydraulically, electrically or by any other conventionally available methods.

A method is provided for forming curved needles from elongated workpieces comprising, providing a forming surface, biasing an elongated workpiece against the forming surface, providing first and second bending dies for contacting ends of the workpiece and bending the ends of the workpiece about the forming surface by moving the bending dies into contact with the ends of the elongated workpiece. The bending dies are preferably reciprocated sequentially, however, they may be configured to reciprocate simultaneously.

Alternatively, the method may further include providing an arm member on each of the bending dies. The arm members each include a roller which contacts the corresponding end of the workpiece and bends it over and about the mandrel.

In another embodiment of the method, the forming surface is moved to bias the workpiece between the forming surface and the retaining surface.

BRIEF DESCRIPTION OF THE DRAWINGS

A more complete appreciation of the present invention and many of the attendant advantages therefo will be readily obtained as the same become better understood by reference to the following detailed description when considered in connection with the accompanying drawings, wherein.

DETAILED DESCRIPTION OF THE PREFERRED EMBODIMENTS

Figure 1:
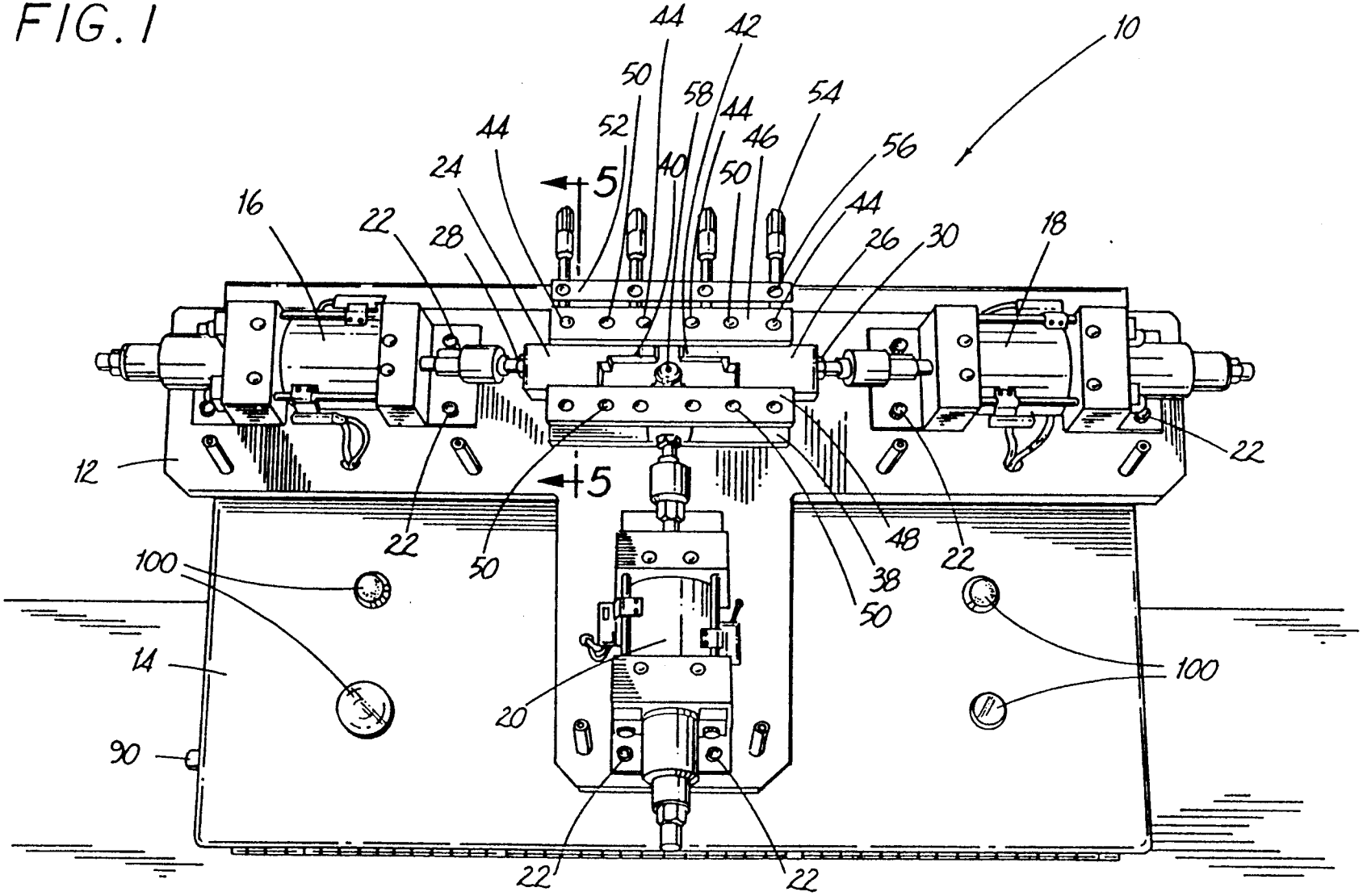
FIG. 1 shows a perspective view of one embodiment of the present invention.

Referring now to the drawings, wherein like reference numerals designate identical or corresponding parts throughout the several views, and initially to FIG. 1, which shows apparatus 10 for forming curved needles. While the following detailed discussion will focus on specific embodiments for needle curving apparatus, it will be recognized by others having ordinary skill in the art that the apparatus will be useful for forming other types of curved articles.

Work station frame 12 is mounted on control panel housing 14 which has several control buttons located thereon for performing various different functions. For example, emergency stopping of apparatus 10, manual retraction of any of dies 24, 26 or 32, and/or switching on or off power to the apparatus may be performed, among others. Control panel housing 14 is formed from suitable metal material such as sheet metal or aluminum. Frame and support members are preferably made of aluminum, whereas workpiece engaging parts are preferably formed from tool steel.

Linear actuators 16, 18 and 20 are mounted on work station frame 12, for example, by bolts 22. Actuators 16, 18, and 20 are known, commercially available devices consisting of a piston connected to a piston rod in a cylinder which is connected to a compressed air source. Solenoids are provided on the actuators to open and shut valves that admit and bleed the compressed air from the cylinders and cause a reciprocating motion of the pistons and piston rods.

Actuators 16 and 18 are operatively connected to bending dies 24 and 26 by, for example, mounting nuts 28 and 30 and actuator 20 is operatively connected to guide die 32 by, for example, mounting nut 34. Actuators 16, 18 and 20 are pneumatically operated and are preferably connected to a compressed air supply by air hoses having quick connect fittings. Alternatively, actuators 16, 18 and 20 may be connected by more permanent coupling methods, known in the art, to a compressed air supply. Actuators 16, 18 and 20 may be replaced by any other known actuators, for example, hydraulic or electric devices. Electrical interlocking circuitry operatively connects actuators 16, 18 and 20 to produce the desired pre-configured firing sequence of guide die 20 and bending dies 16 and 18. The sequence is initiated by depressing start button 90 located on the side of control panel 14. Obviously, the placement of start button 90 is not critical and therefore it may be placed in any suitable location on apparatus 10 or at a remote location from apparatus 10, if so desired. Dies 24 and 26 slide along base plate 36 and are guided by fixed directing barrier 38 and adjustable directing barriers 40 and 42. Directing barriers 38, 40 and 42 are mounted on work station frame 12 by, for example, bolts 44. Cover plates 46 and 48 are fastened to directing barriers 38, 40 and 42 by bolts 50 or any other suitable mounting means, and help direct bending dies 24 and 26 during reciprocation of actuators 16 and 18. L-shaped bracket 52 is attached to base plate 36 by bolts (not shown) and micrometers 54 are retained in holes (not shown) bored through L-shaped bracket 52, by set screws 56 threaded through bracket 52. Micrometers 54 are positioned above adjustable directing barriers 40 and 42 so that one micrometer is positioned above each of bolts 44 on adjustable directing barriers 40 and 42.

Figure 2:
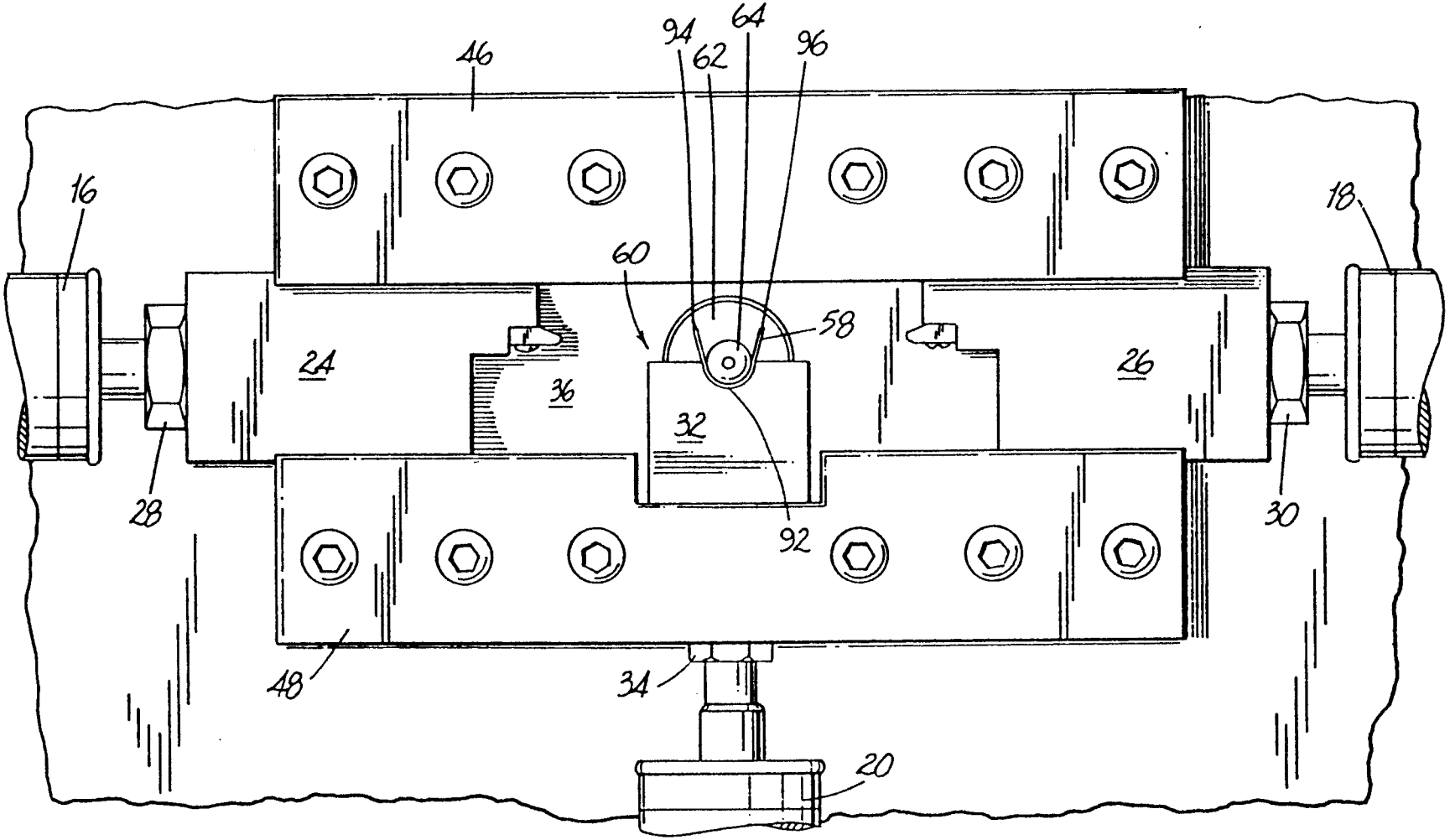
FIG. 2 shows a partial, perspective view of the apparatus of FIG. 1 during sequential operation of a curving procedure.
Figure 3:
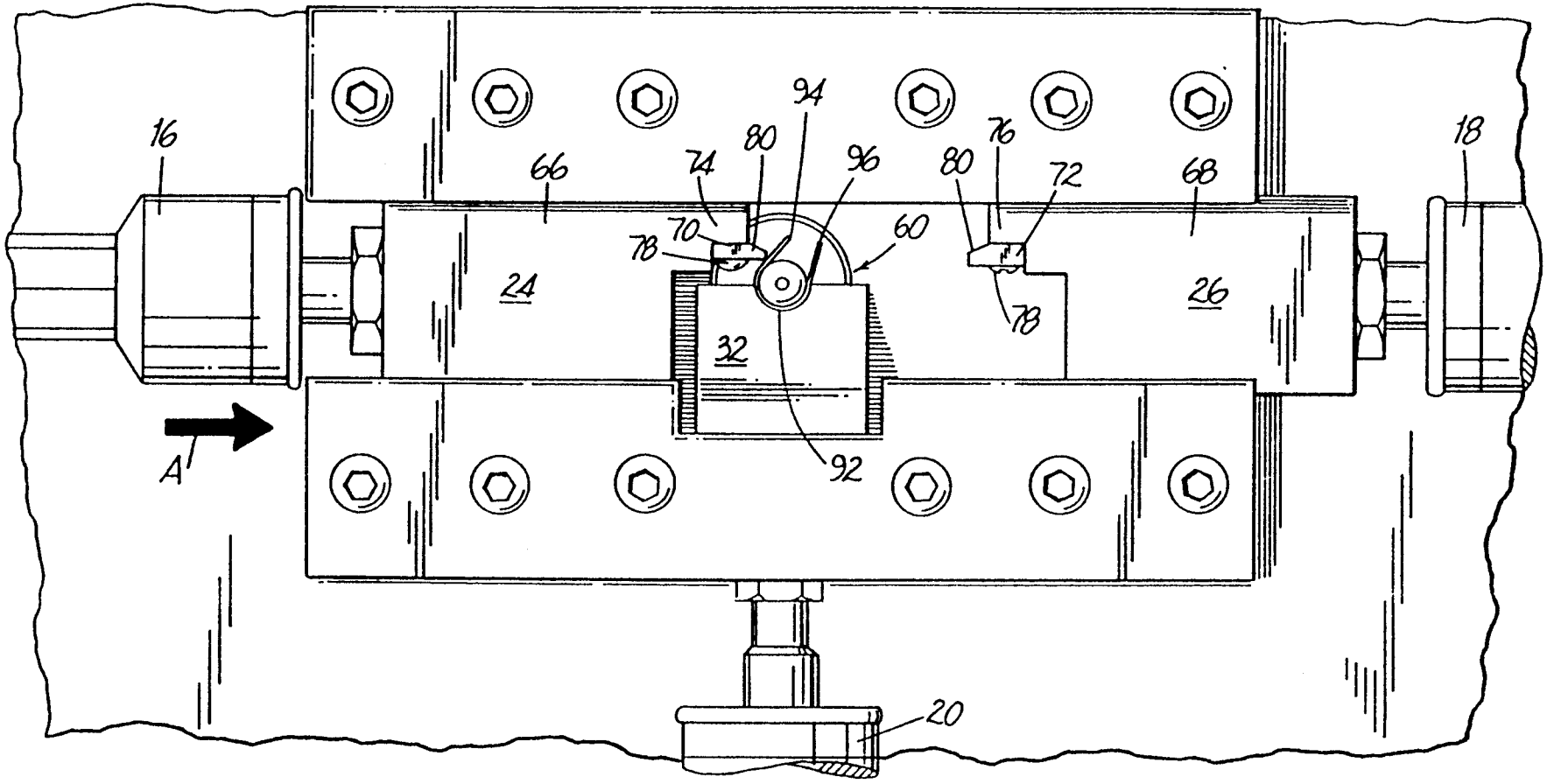
FIG. 3 shows another partial, perspective view of the apparatus of FIG. 1 during sequential operation of a curving procedure.
Figure 4:
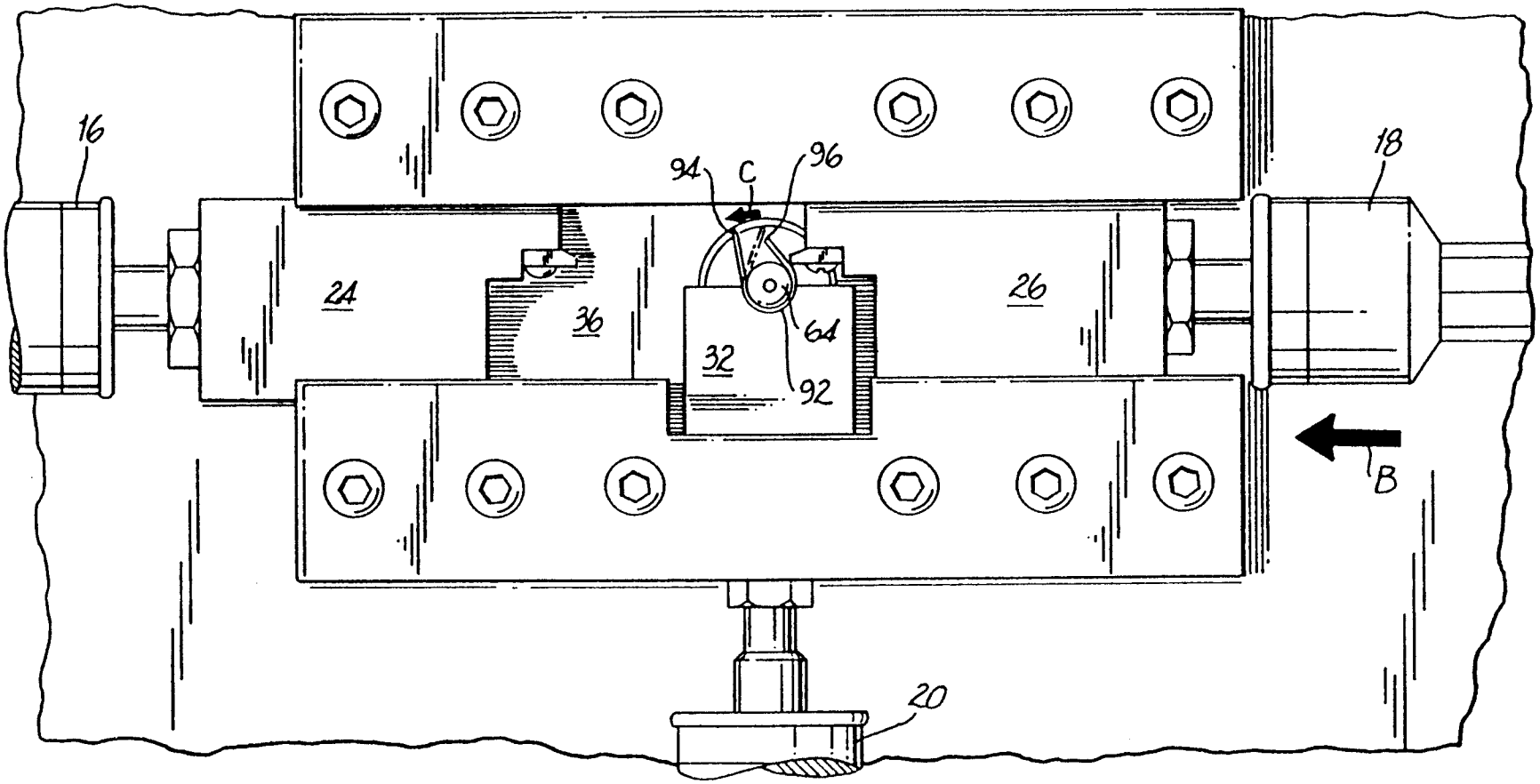
FIG. 4 shows another partial, perspective view of the apparatus of FIG. 1 during sequential operation of a curving procedure.

Referring now to FIGS. 2–4, one possible workpiece forming sequence is illustrated throughout the several views. FIG. 2, illustrates a partial view of the invention, wherein guide die 32 is shown in the fully upward extended position, biasing an elongated workpiece, for example, needle blank 58 against mandrel 60. Mandrel 60 is generally cylindrical with a base portion 62 and a workpiece forming post 64 extending from base 62. In another embodiment, base 62 may be eliminated and the entire mandrel may be of one uniform diameter or cylindrically shaped throughout. Mandrel 60 is secured to base plate 36, preferably being threadably mounted on base plate 36 and partially countersunk in a recessed bore (not shown) cut into base plate 36.

Figure 6:
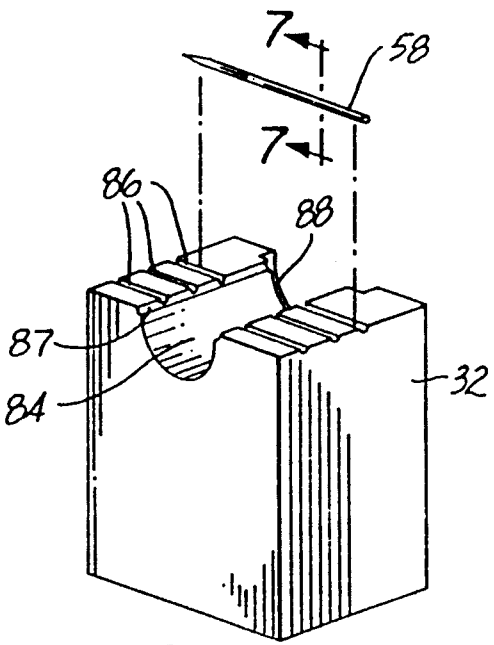
FIG. 6 shows a perspective view of the guide die element of the present invention.
Figure 8:
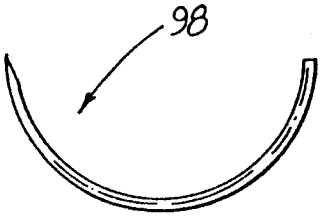
FIG. 8 shows a completed curved needle as formed by the apparatus and method of the present invention.

Referring momentarily now to FIG. 6, one embodiment of guide die 32 is shown as a block with hemispherical hollowed out portion 84 machined transversely across the top of guide die 32. Aligning grooves 86 are machined into both sides of the top of guide die 32 in a transverse manner to and on each side of hemispherical hollowed out portion 84. Ledges 87 are cut longitudinally along the edges of hollowed out portions 84 such that when die 32 contacts mandrel 64 stress needle blank 58 at contact points in alignment with ledges 87 is reduced so as to avoid damaging the needle. Stop 88 is machined into guide die 32 so that stop 88 will contact mandrel base 62 (FIG. 2) thereby preventing guide die 32 from over compressing needle blank 58 and thus causing deformations to the finished needle.

In FIG. 3, bending die 24 having block portion 66 and contact plate 70 is shown in stop-motion as die 24 is advanced in the direction of Arrow A with contact plate 70 pushing blank 58 over and around the top of mandrel 60. Bending dies 24 and 26 have contact plates 70 and 72 attached to upper extended portions 74 and 76 of block portions 66 and 68 by screws 78 or any other suitable fastening devices. Plates 70 and 72 may be made of any durable material, for example, hardened steel, to prevent premature wearing, thereby avoiding the need for constant replacement. Leading edge portion 80 of contact plates 70 and 72 is generally tapered for contacting needle blank 58 in such a way as not to cause significant deformation of needle blank 58. Obviously, contact plates 70 and 72 may be eliminated and dies 24 and 26 may be configured to directly contact needle blank 58. As each die 24 and 26 moves toward mandrel 60, contact plates 70 and 72 strike and bend needle blank 58 around mandrel post 64. During the forming process, guide die 32 continues to bias needle blank 58 against mandrel 60 causing the ends of needle blank 58 to be swept upward in a generally U-shaped position. In FIG. 4, bending die 24 is shown retracted and bending die 26 is shown in stop-motion extending towards needle blank 58 in the direction of Arrow B, pushing needle blank 58 over and across the top of mandrel post 64.

Figure 5:
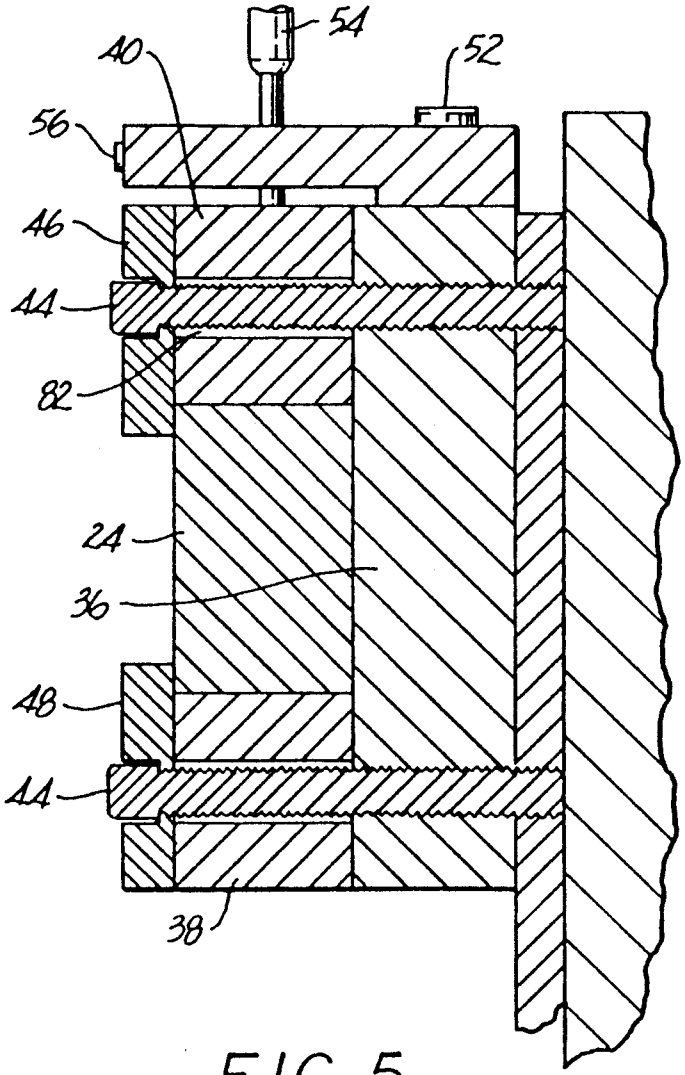
FIG. 5 shows a cross-sectional view taken along section line 5—5 of FIG. 1 illustrating the relationship of the bending dies with respect to the frame and the adjusting micrometers.

Referring now to FIG. 5, which shows a cross-section view taken along line 5—5 of FIG. 1, bending die 24 is shown sandwiched between adjustable directing barrier 40 and fixed directing barrier 38 which are mounted to base plate 36 by, for example, bolts 44. Micrometer 54 is mounted above adjustable directing barrier 40 through bracket 52 by set screw 56. Adjustable directing barrier 40 has bore 82 formed therein for allowing slight movement of adjustable directing barrier 40 in order for adjustments made to the micrometers 54 to effect vertical position changes of bending die 24. These adjustments are necessary for, among other reasons, to account for one side of a needle blank having a taper and the other side having its original dimension unaltered.

Figure 7:
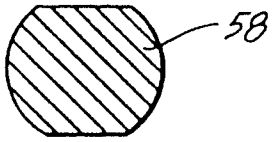
FIG. 7 shows a cross-sectional view of a needle blank taken along section line 7—7 of FIG. 6, illustrating the configuration of the needle blank before the curving process.

In operation, various sizes and types of needle blanks may be used. For example, needle stock having different: material strength characteristics affecting springback values; lengths; diameters; cross-sections, e.g., round, flat (FIG. 7), polygonal; and tapers could all be accommodated by the apparatus of the present invention. In one embodiment, a straight wire stock of .017 inches in diameter made of high tensile strength material, such as stainless steel, is used as the elongated workpiece or needle blank 58 and is pre-tapered and flat pressed on one side and then placed in one of grooves 86 on guide die 32 with a flat side resting on the bottom of the groove (FIGS. 6 and 7). It will be obvious to one of ordinary skill in the art to substitute other known needle materials of differing diameters and material characteristics. The height of bending dies 24 and 26 are adjusted by adjusting micrometers 54 to take into account such variables as the tapered end of the needle blank or the diameter of the wire stock. This adjustment need only be done when different wire stock is used or when needle blanks having differently configured tapers are used. Otherwise, the forming steps may be repeated indefinitely once the correct adjustments are made for a given stock. An automatic curving procedure is then initiated by depressing start button 90 (FIG. 1) which begins an electrically interlocked time sequence for forming the curved needles.

In the embodiment illustrated in FIGS. 2-4, upon initiation of the curve forming sequence, guide die 32 is driven upward by linear actuator 20, pinning needle blank 58 against mandrel 60. As guide die 32 is driven into position, needle blank 58 is bent about mandrel 60 with one flat side of needle blank 58 facing mandrel post 64. Needle blank 58 thereby becomes pinned between contour wall 92 of guide die 32 and mandrel post 64, causing ends 94 and 96 of needle blank 58 to be swept upward and extend upwardly above either side of mandrel post 64. Bending die 24 is then driven from left to right in the direction of Arrow A (FIG. 3) by linear actuator 16 so that plate 70 contacts end 94 of needle blank 58 bending end 94 around the top of mandrel post 64 to a predetermined position depending upon the characteristics of the material used. For example, different materials have different characteristic springback values. Thus, materials with higher springback values need to be overbent more than materials with lower springback values in order to achieve the same curvature for both materials.

Die 24 thereafter retracts in reciprocating fashion to its initial position and end 94 of needle blank 58 partially relaxes due to restoring forces or springback value inherent to the high tensile strength materials used as seen in phantom lines in FIG. 4. Bending die 26 is then driven from right to left in the direction of Arrow B (FIG. 4) by linear actuator 18 toward mandrel 60 so that plate 72 contacts end 96 of needle blank 58 and bends it up and over mandrel post 64. Thereafter bending die 26 retracts in reciprocating fashion to its initial position and end 96 of needle blank 58 is partially restored toward its previous position. Guide die 26 is then retracted to its initial position and curved needle 98 (FIG. 7) is removed.

In other embodiments of the present invention the forming sequence can be adjusted so that both bending dies 24 and 26 are advanced toward mandrel 60 at the same time. Alternatively, guide die 32 may be mounted on base plate 36 and thus become a retaining die. Mandrel 60 may be operatively connected to a linear actuator or other drive mechanism such that upon actuation mandrel 60 is driven toward the retaining die thereby pinning the elongated workpiece against the retaining die in similar fashion as described above. The remainder of the forming sequence would then be much the same as described above.

Needle blank 58 is subjected to overbending throughout each of the above-discussed steps. By overbending, it is meant that the needle blank is curved beyond the desired final curvature of the needle. An illustration of overbending is shown in FIG. 4 where the overbend position of the left side of needle end 94 is shown in phantom. After the release of end 94 by the retraction of die 24, end 94 springs back in the direction of Arrow C. This is necessary because of the high tensile strength, characteristic of the materials used for needle blanks. Depending on the tensile strength of the material used, more or less overbending may be needed. Apparatus 10 may be readily adapted for stock requiring differing degrees of overbending by several methods, including using interchangeable contact plates of differing configurations and mounting different diameter mandrels on base plate.

Figure 9:
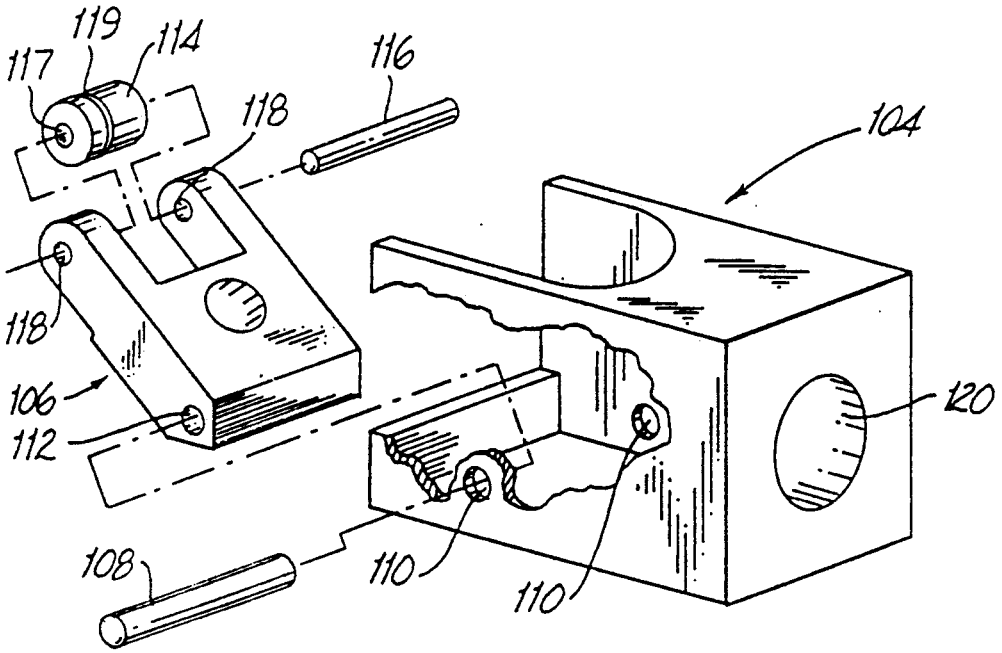
FIG. 9 shows an exploded, partially cut-away view of another embodiment of a bending die of the present invention.

Another possible embodiment of the bending dies suitable for use with the apparatus of the present invention is shown in FIG. 9. Bending die 104 has a similar block shape as other embodiments discussed above, however, one end of die 104 is generally of open construction and is adapted for mounting roller arm 106 by means of pin 108 being inserted through holes 110 and through bore 112 formed in roller arm 106. Roller arm 106 may be rigidly mounted, e.g., by tight interference fitting of the mounting method discussed above or by further welding roller arm 106 in place. Optionally, roller arm 106 may be allowed to pivot while retaining enough rigidity to bend needle stock 58 upon contact therewith in the curving process. Roller 114 is mounted on roller arm 106 by inserting pin 116 through holes 118 formed in roller arm 106. Pin 116 preferably has a diameter slightly less than the diameter of bore 117 in roller 114 so that after mounting on arm 106, roller 114 may freely rotate about pin 116.

Groove 119 is provided in roller 114 and is aligned to receive needle stock such as needle stock 58 of FIG. 6 during the curving procedure. By such an arrangement, the needle stock (not shown) is given lateral stability and prevented from moving, i.e., sliding out of transverse alignment with the mandrel post 134 such as post 134 illustrated in FIG. 11. Die 104 is mounted to reciprocating actuators such as those discussed above by way of bore 120.

Figure 10:
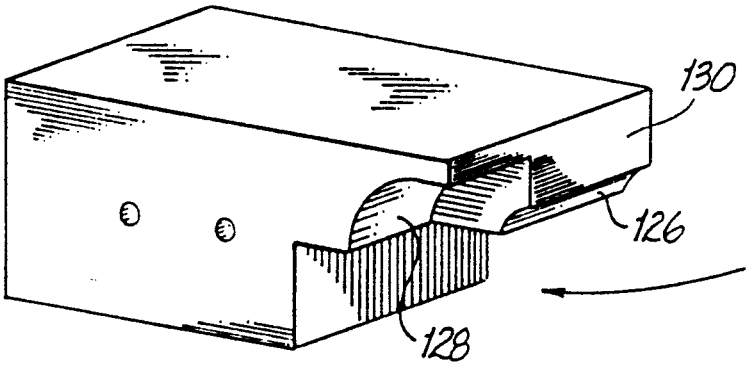
FIG. 10 shows a rear perspective view from the rear of another embodiment of a bending die of the present invention.
Figure 11:
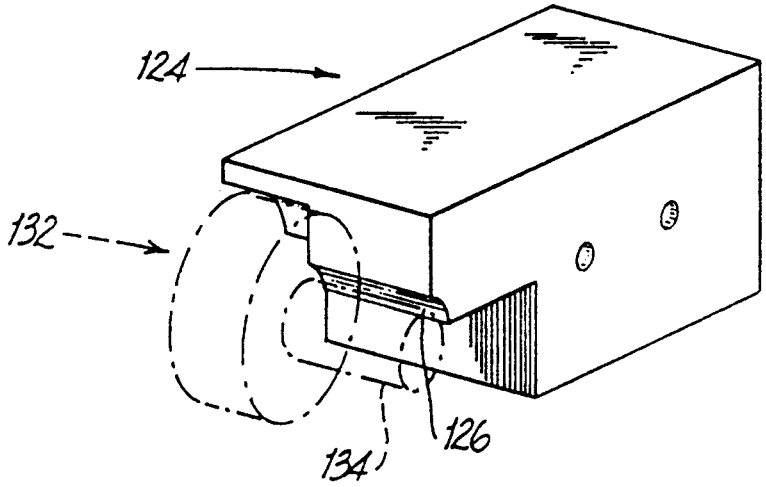
FIG. 11 shows a front left side perspective view of the bending die of FIG. 10 in relation to a mandrel shown in phantom.

FIGS. 10 and 11 illustrate yet another possible embodiment of the bending die for use with the apparatus of the present invention. Bending die 124 is shown having contoured portions 126 and 128 formed at end 130 which are suitable for mating with the contours of a mandrel surface such as mandrel 132 shown in phantom in FIG. 11. In this embodiment die 124 is of unitary construction thus avoiding the need for additional assembly of moving parts. Curved needles are formed by contoured portion 126 contacting an end portion of the needle stock and bending the same over the top of mandrel post 134 and thereafter compressing the material between bending die 124 and mandrel 132 such that the needle stock is forced to take the shape of mandrel post 134 and die contour 126.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. Apparatus for forming curved surgical needles from elongated workpieces of high tensile strength material, said elongated workpieces having a taper preformed at least at one of a first end and a second end thereof, comprising:

a frame including a forming surface demountably attached thereto;

means movably mounted on said frame for securely biasing said elongated workpieces against said forming surface in a fixed position; and means movably mounted on said frame for bending said elongated workpieces about said forming surface, said bending means cooperating with said forming surface such that upon initial contact between said bending means and said first and second ends, said bending means does not contact the respective terminal section of said first and second ends whereby said pre-formed taper remains intact throughout the bending of said elongated workpiece.

2. Apparatus according to claim 1 wherein said bending means comprises at least one bending die disposed adjacent said forming surface.

3. Apparatus according to claim 2 further comprising means disposed adjacent said bending die for adjusting the position thereof in relation to said forming surface.

4. Apparatus according to claim 3 wherein said adjusting means comprises means mounted on said frame adjacent said bending die for directing said bending die such that upon movement said bending die approaches said forming surface at a predetermined displacement to contact said workpiece for bending same about said forming surface.

5. Apparatus according to claim 4 wherein said adjusting means further comprises at least one micrometer, operably mounted adjacent said directing means, to position said directing means in a predetermined position.

6. Apparatus according to claim 2 wherein said bending means further comprises workpiece contact plates demountably attached thereto.

7. Apparatus according to claim 2 wherein said bending means further comprises an arm member such that upon movement of said bending die towards said forming surface said arm member contacts said workpiece and urges said workpiece about said forming surface.

8. Apparatus according to claim 7 wherein said arm member includes a roller mounted thereon such that when said bending die is moved toward said forming surface said roller contacts said workpiece and rolls as it urges said workpiece about said forming surface.

9. Apparatus according to claim 7 wherein said arm member is pivotally mounted on said bending die.

10. Apparatus according to claim 2 wherein said bending die includes an end portion having a contoured shape for mating with said forming surface such that upon movement of said bending die toward said forming surface said elongated workpiece is bent about said forming surface.

11. Apparatus according to claim 1 wherein said biasing means comprises a guide die adapted for bending said elongated workpiece about said forming surface and biasing said elongated workpiece against said forming surface upon movement of said die towards said forming surface.

12. Apparatus according to claim 11 wherein said guide die further comprises means for aligning said elongated workpiece in longitudinal relation to said forming surface.

13. Apparatus according to claim 12 wherein said workpiece aligning means comprises at least one groove, adapted for receiving said elongated workpiece on said guide die.

14. Apparatus according to claim 11 wherein said forming surface comprises a circular mandrel disposed adjacent and aligned with a hollowed out hemispherical portion of said guide die.

15. Apparatus according to claim 1, further comprising means operatively connected to said biasing means and said bending means for reciprocatingly urging said guide means and said bending means toward and away from said forming surface.

16. Apparatus according to claim 15 wherein said urging means comprise linear actuators.

17. Apparatus according to claim 16 wherein said linear actuators are operated pneumatically.

18. Apparatus for forming curved surgical needles from elongated workpieces, said elongated workpieces having a taper pre-formed at least at one of a first or a second ends, the apparatus comprising:

a frame including a forming surface demountably attached thereto;

a guide member movably mounted on said frame, said guide member being adapted for securely biasing said elongated workpieces against said forming surface in a fixed position; and first and second means mounted on said frame for bending said workpieces about said forming surface, said bending means being adapted for sequentially urging said elongated workpiece about said forming surface, said bending means cooperating with said forming surface such that upon initial contact between said bending means and said first and second ends, said bending means does not contact the respective terminal section of said first and second ends whereby said pre-formed taper is kept intact throughout the bending of said elongated workpieces.

19. Apparatus according to claim 18 wherein said forming surface comprises a circular mandrel disposed adjacent and aligned with a hollowed out hemispherical portion of said guide member.

20. Apparatus according to claim 18 further comprising means, disposed adjacent said bending means, for adjusting the position of said bending means in relation to an end portion of said elongated workpiece.

21. Apparatus according to claim 20 wherein said adjusting means comprises means mounted on said frame adjacent said bending means for directing said bending means such that said bending means approaches said forming surface at the appropriate displacement to contact said workpiece for bending same about said forming surface.

22. Apparatus according to claim 21 wherein said adjusting means further comprises at least one micrometer operably mounted adjacent said directing means to position said directing means.

23. Apparatus according to claim 18 wherein said first and second bending means each comprise:

a block member; and a workpiece contact plate demountably attached to said block member.

24. Apparatus according to claim 18 wherein said guide member further comprises aligning means for aligning an elongated workpiece in longitudinal relation to said forming surface.

25. Apparatus according to claim 24 wherein said aligning means comprises at least one groove on said guide member adapted for receiving an elongated workpiece.

26. Apparatus according to claim 18 further comprising means operatively connected to said guide means and said bending means for reciprocatingly urging said guide means and said bending means toward and away from said forming surface.

27. Apparatus for forming curved surgical needles from elongated workpieces, such elongated workpieces having a taper pre-formed at least at one of a first and second ends comprising:

a frame including a forming surface demountably attached thereto;

a guide member movably mounted on said frame, adapted for biasing said elongated workpieces against said forming surface in a fixed position; and first and second bending means slidably mounted on said frame wherein said bending means simultaneously advance towards said first end and said second end of said elongated workpiece respectively thereby contacting said workpiece ends and bending said ends about said forming surface, said bending means cooperating with said forming surface such that upon initial contact between said bending means and said first and second ends, said bending means does not contact the respective terminal section of said first and second ends whereby said pre-formed taper remains intact throughout the bending of said first and second ends.

28. Apparatus according to claim 27 wherein said forming surface comprises a circular mandrel disposed adjacent and aligned with a hollowed out hemispherical portion of said guide member.

29. Apparatus according to claim 28 further comprising adjusting means, disposed adjacent said bending means, for adjusting the position of said bending means in relation to said first and second ends of said elongated workpiece.

30. Apparatus according to claim 29 wherein said adjusting means comprises means mounted on said frame adjacent said bending means for directing said bending means such that upon advancement of said bending means toward said forming surface said bending means approach said forming surface at the appropriate displacement to contact said workpiece for bending same about said forming surface.

31. Apparatus according to claim 30 wherein said adjusting means further comprises at least one micrometer operably mounted adjacent said directing means to engage and position said directing means.

32. Apparatus according to claim 27 wherein said first and second bending means each comprise:

a block member; and a workpiece contact plate demountably attached to said block member.

33. Apparatus according to claim 27 wherein said guide member further comprises aligning means for aligning said elongated workpiece in longitudinal relation to said forming surface.

34. Apparatus according to claim 33 wherein said aligning means comprises at least one groove adapted for receiving said elongated workpiece on said guide member.

35. Apparatus according to claim 27 further comprising means operatively connected to said guide means and said bending means for reciprocatingly urging said guide means and said bending means toward and away from said forming surface.

36. Apparatus for forming curved surgical needles from elongated workpieces, said elongated workpieces having a first end and a second end and a taper preformed at least one of said first or second ends, the apparatus comprising:

a frame including retaining means mounted thereon for retaining said elongated workpieces;

movable forming means for securely biasing said elongated workpieces against said retaining means in a fixed position said forming means being disposed adjacent said retaining means; and bending means, movably mounted on said frame, for bending said elongated workpieces about said forming means, said bending means cooperating with said forming means such that upon initial contact between said bending means and said first and second ends, said bending means does not contact the respective terminal section of said first and second ends whereby when said bending means bends said previously tapered elongated workpiece said taper remains intact.

37. Apparatus according to claim 36 wherein said retaining means comprises a die having at least one groove thereon for retaining said elongated workpieces.

38. Apparatus according to claim 36 wherein said movable forming means comprises a circular mandrel disposed adjacent said retaining means.

39. Apparatus according to claim 36 wherein said bending means comprises at least one bending die disposed adjacent said retaining means.

40. Apparatus according to claim 36 further comprising adjusting means, disposed adjacent said bending means, for adjusting the position of said bending means in relation to an end portion of said elongated workpieces.

41. Apparatus according to claim 40 wherein said adjusting means comprises means mounted on said frame adjacent said bending means for directing said bending means such that said bending means approaches said forming surface at the appropriate displacement to contact said workpiece for bending same about said forming surface.

42. Apparatus according to claim 41 wherein said adjusting means further comprises at least one micrometer operably mounted, adjacent said directing means, to position said directing means.

43. Apparatus according to claim 40 further comprising means, operatively connected to said forming means and said bending means, for reciprocatingly urging said forming means and said bending means toward and away from said retaining means.

44. A method for forming curved surgical needles from elongated workpieces, said elongated workpieces having a taper pre-formed at least at one of a first and second ends thereof, the method comprising the steps of:

(a) providing a forming surface;
(b) biasing an elongated workpiece against said forming surface into a fixed position;
(c) providing first and second bending dies for contacting ends of said workpiece; and
(d) bending said ends of said elongated workpiece about said forming surface by moving said bending dies into contact with said ends of said elongated workpiece without initially contacting the terminal section of the ends such that said pre-formed taper remains intact throughout the bending of said first and second ends.

45. The method of claim 44 wherein the bending of step (d) is accomplished by reciprocating said bending dies in sequence so as to contact said ends of said workpiece bending them about said forming surface.

46. The method of claim 44 wherein the bending of step (d) is accomplished by reciprocating said bending dies simultaneously so as to contact said ends of said workpiece bending them about said forming surface.

47. The method of claim 44 wherein step (c) further includes providing an arm member on each of said bending dies wherein each said arm member comprises a roller such that upon movement of said bending dies towards said elongated workpiece ends are contacted by said roller and bent over and around said forming surface.

48. A method for forming curved surgical needles from elongated workpieces of high tensile strength material, said elongated workpieces having a taper preformed at least at one of a first and a second ends, the method comprising the steps of:

(a) providing a movable forming surface;
(b) providing a retaining surface for holding at least one elongated workpiece;
(c) biasing an elongated workpiece against said retaining surface into a fixed position by moving said forming surface toward said retaining surface;
(d) providing first and second bending dies for contacting ends of said workpiece; and
(e) bending said ends of said elongated workpiece by reciprocatingly sliding said bending dies so as to contact said ends of said workpiece bending them about said forming surface without initially contacting the terminal section of the ends such that said pre-formed taper remains intact throughout said bending.

* * * * *